US008443918B2

(12) United States Patent
Massari

(10) Patent No.: US 8,443,918 B2
(45) Date of Patent: May 21, 2013

(54) EXCAVATION AND COMPACTION EQUIPMENT FOR THE CONSTRUCTION OF SCREW PILES

(75) Inventor: Stefano Massari, Cesena (IT)

(73) Assignee: Soilmec S.p.A., Cesena (FC) (IT)

( * ) Notice: Subject to any disclaimer, the term of this patent is extended or adjusted under 35 U.S.C. 154(b) by 353 days.

(21) Appl. No.: 12/762,758

(22) Filed: Apr. 19, 2010

(65) Prior Publication Data

US 2010/0263928 A1 Oct. 21, 2010

(30) Foreign Application Priority Data

Apr. 20, 2009 (IT) ..... TO2009A0310

(51) Int. Cl.
*E21B 10/44* (2006.01)
*E21B 17/22* (2006.01)

(52) U.S. Cl.
USPC ..... 175/323; 175/394; 405/252.1

(58) Field of Classification Search ..... 175/232, 175/323, 394; 405/252.1; 37/350, 189
See application file for complete search history.

(56) References Cited

U.S. PATENT DOCUMENTS

| | | | | |
|---|---|---|---|---|
| 2,401,250 A * | 5/1946 | Kandle | ..... | 175/242 |
| 5,013,191 A * | 5/1991 | Kitanaka | ..... | 405/233 |
| 5,722,498 A * | 3/1998 | Van Impe et al. | ..... | 175/394 |
| 5,875,860 A * | 3/1999 | Coelus | ..... | 175/323 |
| 6,283,231 B1 * | 9/2001 | Coelus | ..... | 175/323 |
| 7,357,199 B2 * | 4/2008 | Pedrelli | ..... | 175/241 |
| 2007/0023207 A1 * | 2/2007 | Perpezat et al. | ..... | 175/394 |

FOREIGN PATENT DOCUMENTS

| | | |
|---|---|---|
| EP | 1 726 718 | 11/2006 |
| JP | 05346092 A * | 12/1993 |

* cited by examiner

*Primary Examiner* — Kenneth L Thompson
(74) *Attorney, Agent, or Firm* — Merchant & Gould P.C.

(57) ABSTRACT

Excavation equipment for the construction of compaction piles includes a tool mounted at the end of a drilling rod; the tool is constituted by a shaft (10) provided on its end with digging teeth (12) and with at least a plate (14) for collecting debris rotating between an open position during the excavation and closed during the ascent of the tool. A screw (17, 18, 17', 18', 20); is of the type having at least two principles (17, 18, 20), in the upper part (20) fixed directly on the shaft (10) and in the lower part (17, 18) fixed on a cylindrical element (16) inserted on the shaft. A compactor (19) is positioned on the screw (17, 18) of the cylindrical element (16). The shaft rotates between two positions displaced between them, one corresponding to the excavation condition and the other to the ascent one; each of the at least two-principle screws of the shaft (20) constitutes the continuation of a corresponding screw (17, 18) of the cylindrical body (16) depending on the angular position of the shaft (10).

10 Claims, 10 Drawing Sheets

Sec. J-J.

Sec. H-H

Sec. J-J

Sec. H-H

Sec. H-H

Sec. K-K

Sec. J-J

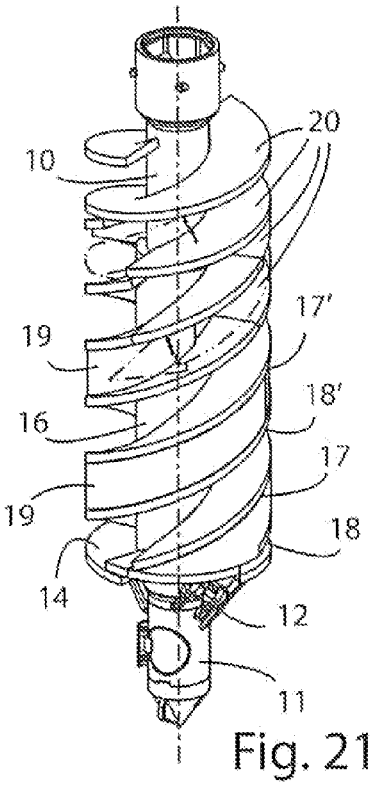
Fig. 21
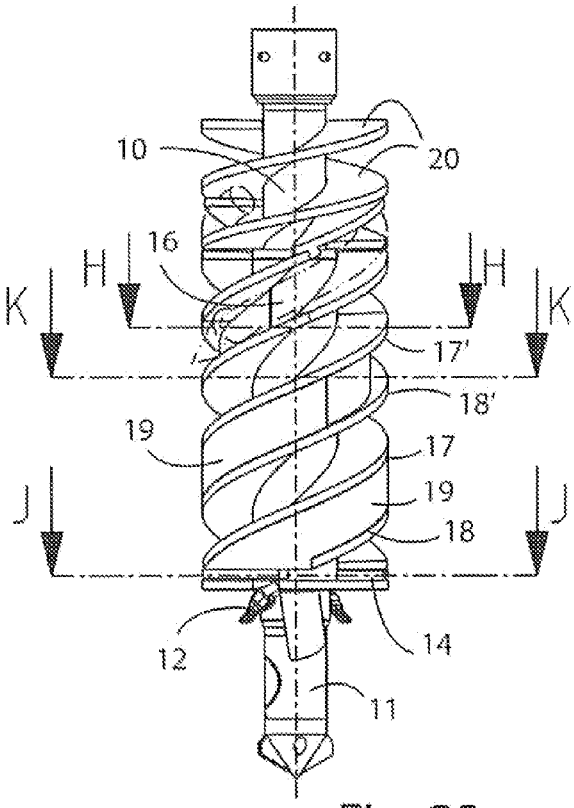
Fig. 22
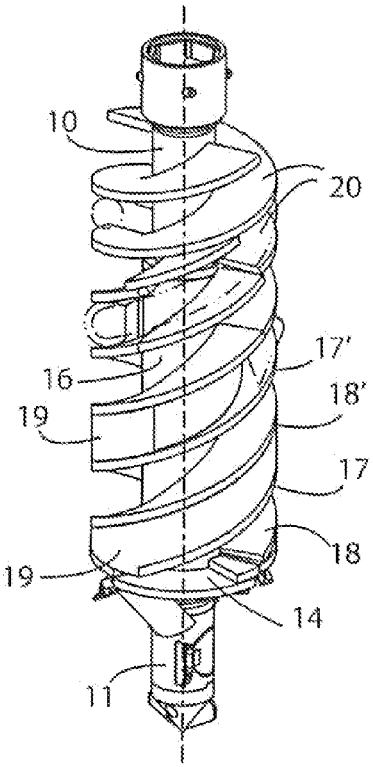
Fig. 23
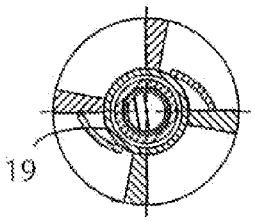
Fig. 24
Sec. H-H
Fig. 25
Sec. K-K
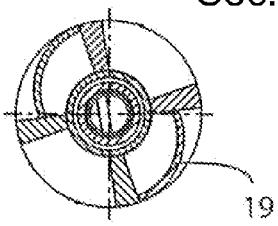
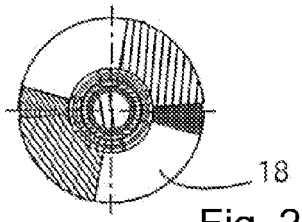
Fig. 26
Sec. J-J

EXCAVATION AND COMPACTION EQUIPMENT FOR THE CONSTRUCTION OF SCREW PILES

This application claims benefit of Serial No. TO 2009 A 000310, filed 20 Apr. 2009 in Italy and which application is incorporated herein by reference. To the extent appropriate, a claim of priority is made to the above disclosed application.

BACKGROUND

The present invention relates to an excavation and compaction equipment for the construction of piles.

From the European patent EP 1726718 A1 it is known a tool designed for carrying out piles through compaction of the soil during the step of ascent with inversion of the direction of rotation.

The tool of this patent is comprises a shaft body, carried by the drilling rod, provided:

- in the lower part with a plate provided with digging teeth and rotating with the drilling rod to which it is connected;
- in the upper part with a screw tract for collecting the excavation material and
- in its central portion, always provided with screw, with an element for the compaction of the removed soil during the drilling, and with a blocking device selectively reclosable depending on the excavation and compaction conditions.

In the body it is provided a canalisation for the passage of the externally supplied concrete and which exits in correspondence with the digging teeth.

One of the main issues caused by the tool described in that patent is the instability of the hole after the compaction which creates collapses and inclusions of soil in the part of the casting. In this way, the quality of the pile is scarce and in some cases not suitable for the application.

Furthermore, the parts which lock the counter-rotating structure of the tool to the soil, in such a way as to create a relative angular rotation between the part put into rotation by the rotation head and the one which carries the plate, in some cases can be not enough for completing the closing, with consequent issues in the carrying out of the pile because the part of the casting is not separated from the one wherein the soil is compacted.

In the most general conditions, it has been noticed that the trend of the compacted hole is to get tightened (revealed by the fact that in some cases it is difficult to insert the cages in the hole) because the axially limited compacted zone and the high specific working pressures, make uncontrolled transfers of material happen through the interspace plate-hole, with consequent inclusions of the soil in the zone used for the casting.

On the other hand, in other cases, the storage of the material against the part which provides the compaction creates a successive storage of compacted soil layers on the tool which, in certain typologies of soil, can lead to make a pile with diameter higher than the nominal one. This causes extra consumptions of the casting which are economically unexpected.

SUMMARY

The purpose of the present invention is to make an excavation and compaction equipment for the construction of tensioned compacted piles, which is free from the above described disadvantages.

In order to reach these and other purposes which will be better understood hereinafter, the invention proposes to make an excavation and compaction equipment for the construction of piles.

BRIEF DESCRIPTION OF THE DRAWINGS

The tool will be now described according to the invention in some of its embodiments with reference to the attached drawings wherein:

FIGS. 5-7 show it in three positions differently pitched on the vertical axis, in the excavation condition, whereas FIGS. 8 and 9 are the respective sections of FIG. 6; FIGS. 10-12 show it in three positions differently pitched on the vertical axis, in the compaction condition, whereas FIGS. 13 and 14 are the respective sections of FIG. 11;

FIGS. 15-26 show the tool according to the invention in a third embodiment wherein the tool shows four-principle screws (17, 17', 18, 18') of which the two opposite ones are dedicated to the ascent of the material and the other two to the compaction; in particular FIGS. 15-17 show it in three positions differently pitched on the vertical axis, in the excavation condition, whereas FIGS. 18, 19 and 20 are the respective sections of FIG. 16; FIGS. 21-23 show it in three positions differently pitched on the vertical axis, in the compaction condition, whereas FIGS. 24, 25 and 26 are the respective sections of FIG. 22;

DETAILED DESCRIPTION

Figure 1:
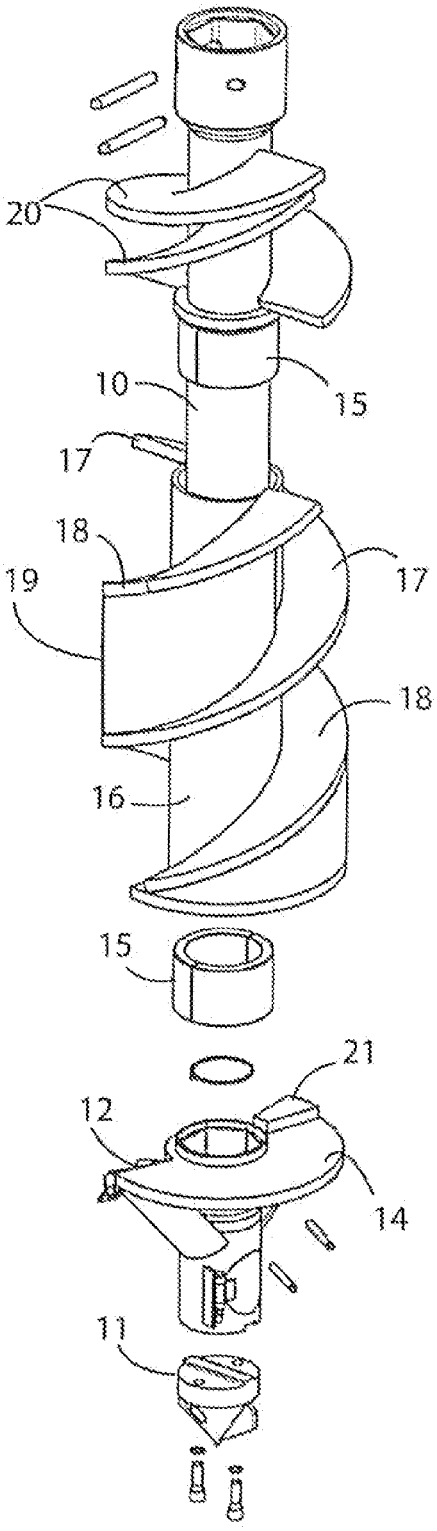
FIG. 1 is an exploded view of the tool according to the invention in a first embodiment wherein the tool has a double screw.
Figure 2:
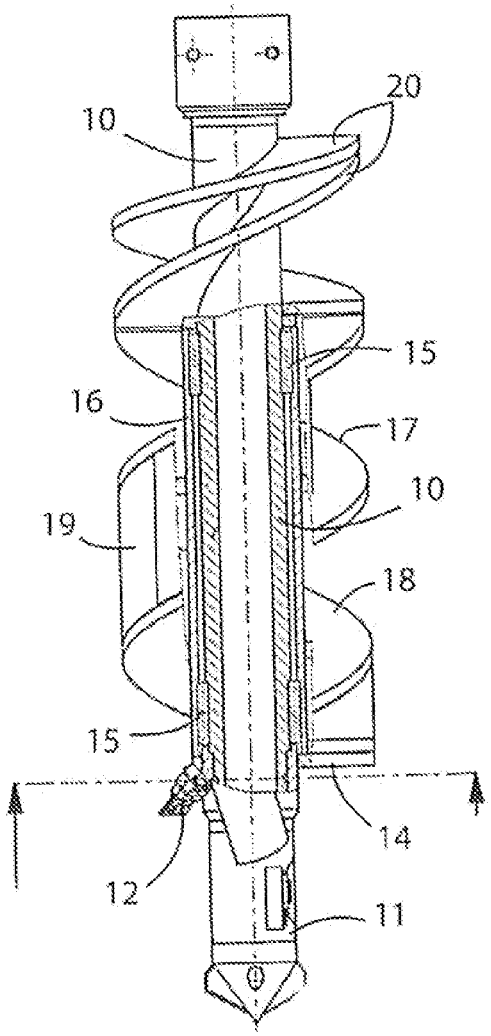
FIG. 2 is a partially sectioned view of the tool of FIG. 1.

First of all, we consider the first embodiment shown in FIGS. 1-4; the tool is constituted by a central shaft 10 connected to the battery of rods (not shown) of the drilling machine; a drilling tip 11 is integral on the lower part with shaft 10 which carries rotating plate 14 with digging teeth 12.

A cylindrical element 16, provided with a two-principle screw 17 and 18, wherein the screws are angularly displaced by 180°, is threaded into central shaft 10, becoming coaxial to it, and is provided with an element for compaction 19, interposed for a certain tract between two screws 17 and 18; the element for compaction 19 extends from the periphery towards the interior of the screws themselves with a radial development decreasing towards the interior.

A semi-circular plate 14, integral with rotating tip 11, constitutes a lower selector movable between two extreme positions pitched by 180°. During the ascent and after the inversion of the direction of rotation, this selector element, completely closes the transversal section of the hole by creating a separation between the upper compacted zone and the lower casting zone, forcing the soil to transit through the compacted zone.

The upper portion of shaft 10 is provided with double screw 20, adapted to form extension of the two-principle screw 17 and 18 of cylindrical element 16. This double screw forms an upper selector element movable between two extreme positions pitched by 180°. During the ascent and after the inversion of the direction of rotation (still given by the rod to shaft 10) this selector element, closes the area for the ascent of the material comprised between two screws 17 and 18, forcing the soil to transit through the compacted zone, on the opposite space still delimited by the described screws.

Two bushings 15 separate the rotating parts (tip 11, semi-circular plate 14, shaft 10 and double screw 20) from intermediate circular element 16, whereas a stop 21 acts as ledge of semi-circular plate 14 against the ends of screws 17 and 18 at the end of the rotation by 180° in both the directions.

Figure 4:
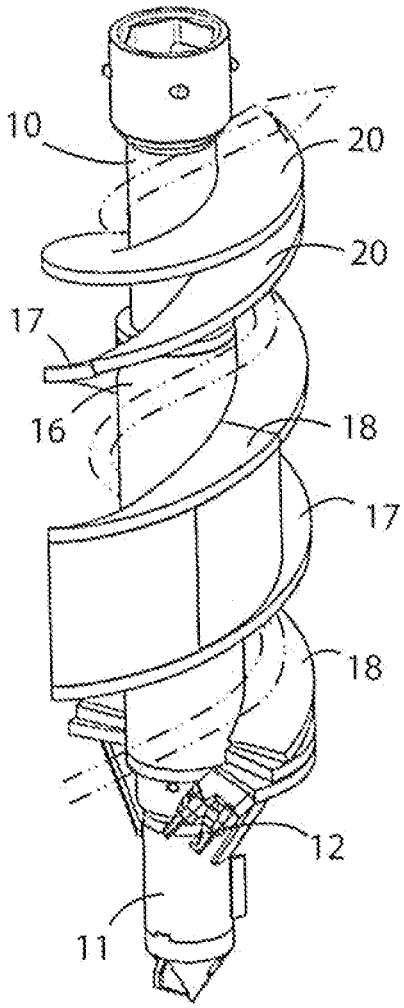
Figure 5:
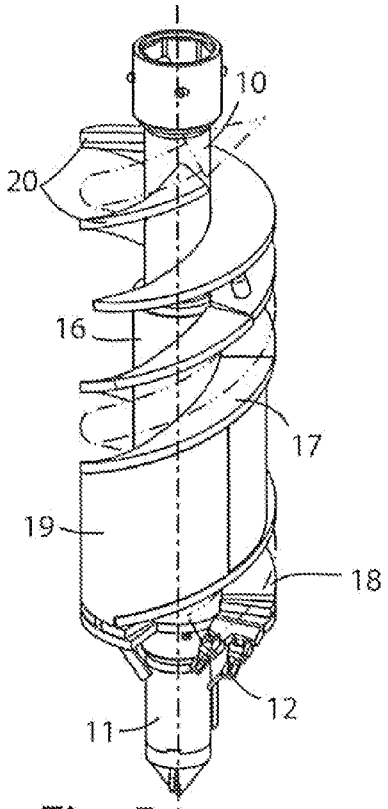
FIGS. 5-14 show the tool according to the invention in a second embodiment wherein the tool has two-principle screws with non-equal pitch; in particular.
Figure 6:
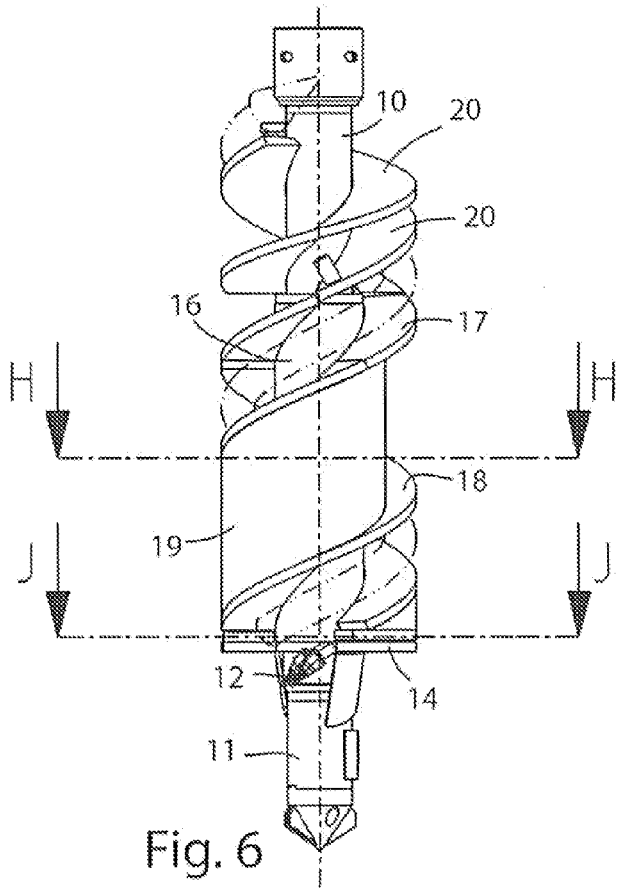
Figure 7:
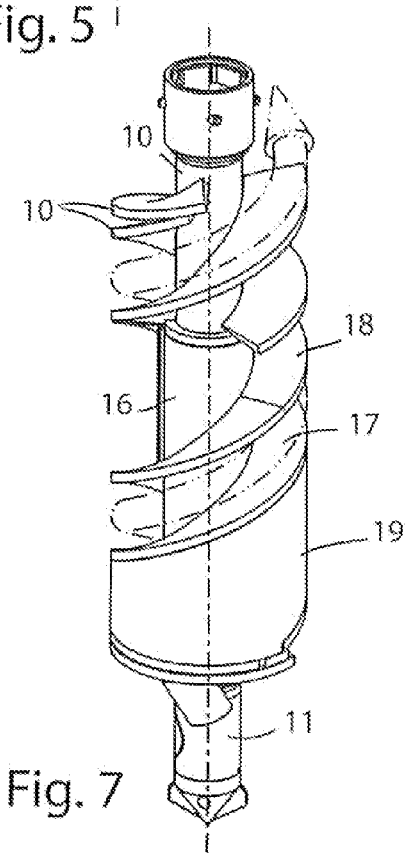
Figure 9:
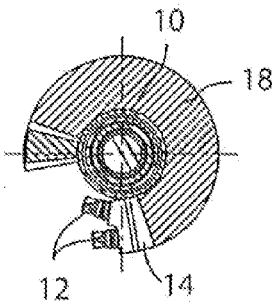
Figure 8:
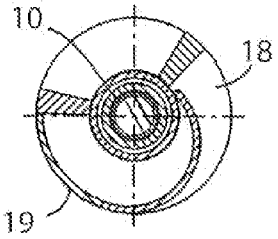
Figure 10:
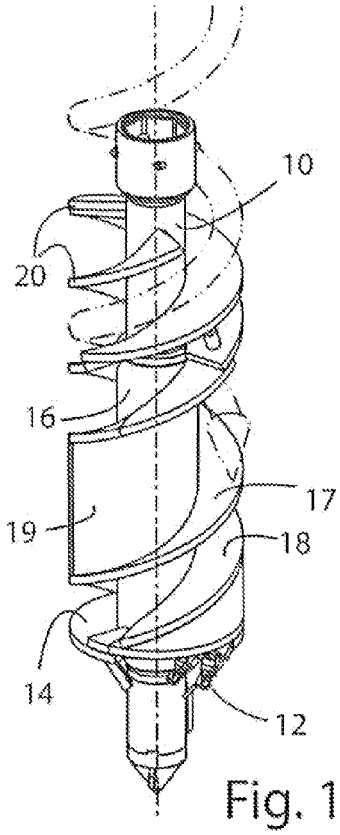
Figure 11:
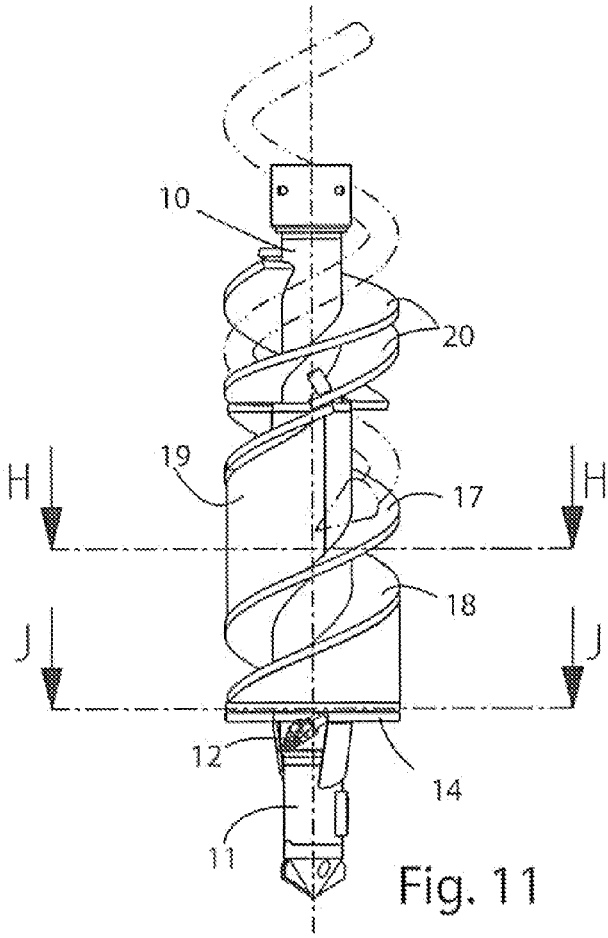
Figure 12:
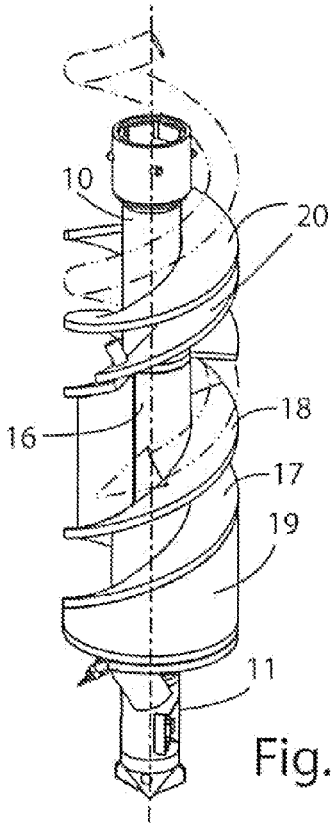
Figure 14:
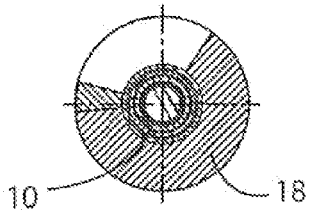
Figure 13:
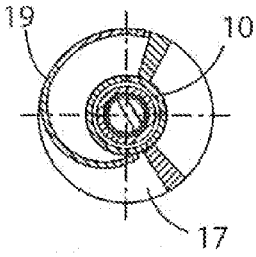
Figure 15:
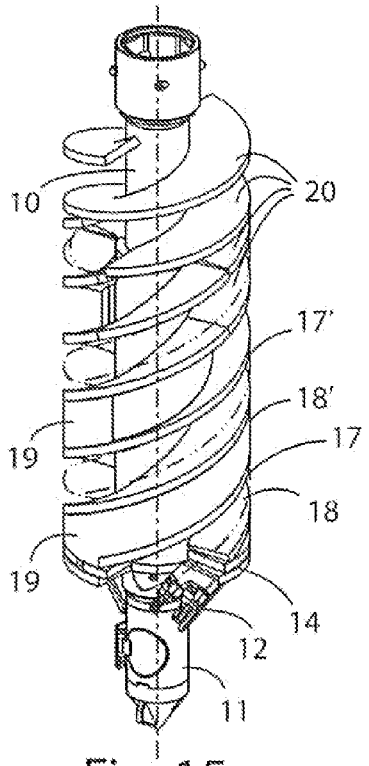
Figure 16:
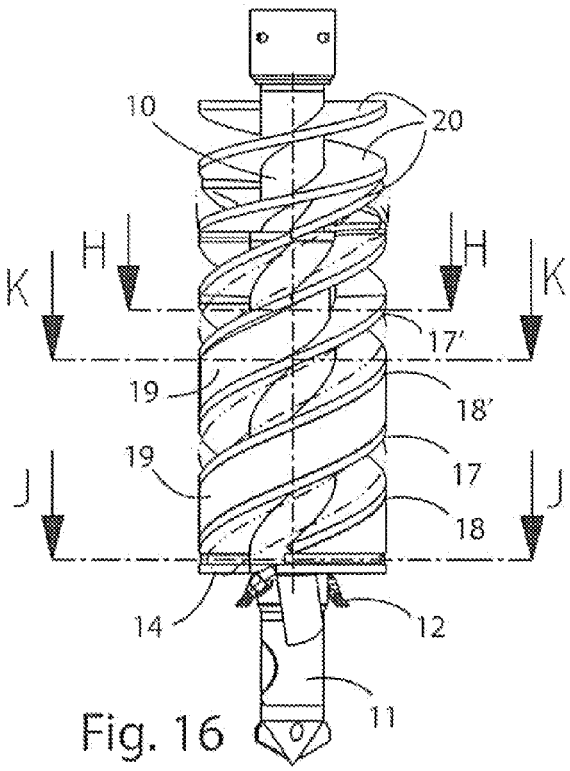
Figure 17:
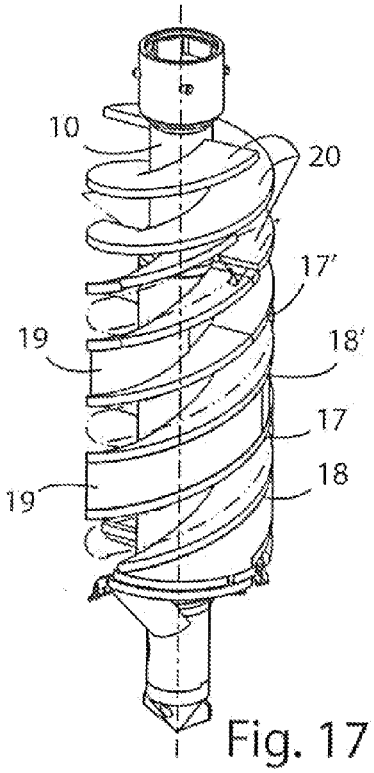
Figure 18:
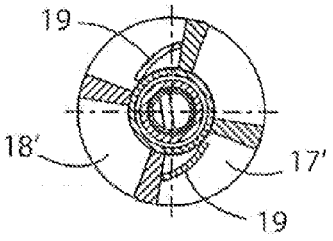
Figure 19:
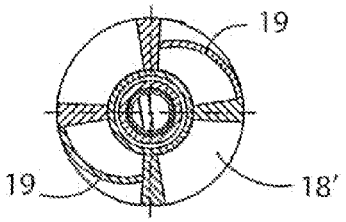
Figure 20:
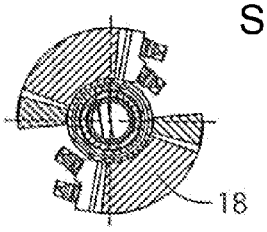

In FIG. 4 there is the excavation condition wherein semi-circular plate 14 is rotated under screw 18 (in open condition), and the soil removed by tools 12 is free to flow along the helical path indicated by the arrow toward the top of the tool.

Figure 3:
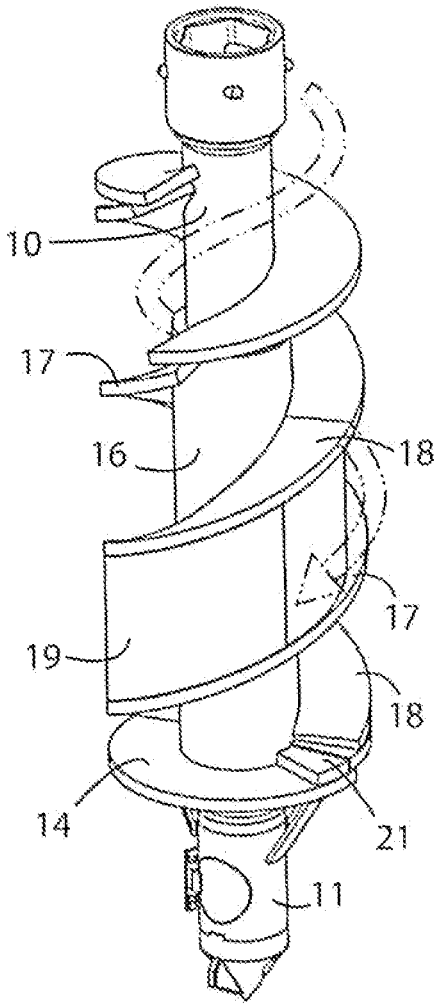
FIGS. 3 and 4 are views of the tool of FIG. 1 in two positions rotated by 180° the one with respect to the other and in two different operating conditions.

In FIG. 3, instead, there is the condition wherein the excavation is finished and the tool is in the step of ascent with upper screws 20 rotated by 180° just as semi-circular plate 14 whose stop 21 rests against screw 18 (in closed condition).

Plate 14 prevents the debris from falling in the hole created during the ascent of the tool whereas the soil can go back down along the path indicated by the arrow until it reaches compaction tract 19 which, thanks to its significant axially conformation and to its radial development increasing outwards, compacts it little by little against the walls of the hole created.

Advantageously, plate 14 can be removed with respect to shaft 10 and to it coupled for transferring the necessary forces for the work.

The system differentiates from the typologies of tensioned compaction tools because it has a double body (of screw 20 and of cylindrical body 16) and a very extended zone 19 of "stabilization" of the hole in such a way as to contain the relaxing of the soil and stabilize it to the nominal compacted diameter preventing from collapsing.

This part 19 stabilizing to the maximum diameter, as shown in the figures, is relatively elevated because its axial extension is nearly one, one and a half times the maximum diameter of the tool. In this way, the soil is sustained at the compaction size for a time suitable for preventing relaxations of the hole, collapses of the walls and transfers of material in the lower space assigned for the casting. Another characteristic of stabilizing zone 19 is to have a very significant angular extension, in figure is for instance represented by an extension of a complete revolution for better equilibrating the compaction thrusts, generated by a symmetrical geometry. Generally, the angular extension is determined as consequence of the axial length of the chosen stabilization tract and of the pitch of the screw which depends instead on the type of the soil to be drilled.

In FIGS. 5-14, it is shown an embodiment alternative to the one previously described, wherein the screw principles are still two, but the angular displacement is not anymore by 180° but for instance by 120°.

It can be noticed that in this case it is advantageously possible to obtain different passing volumes and proportional to the chosen angle (120° produce a 1:2 ratio on the two volumes separated by screws 17 and 18). Therefore, with this angular form it is possible to leave less space to the ascent of the soil favourable to a higher volume (double) to dedicate to the material in compaction. In this way, it is possible to find optimal forms combining the displacement of screws 17, 18 and of compaction part 19, for adapting to the different excavation needs and depending on the soils themselves. By simply replacing the external body which is threaded on shaft 10, it is possible to modify the behaviour of the tool in order to increase the efficiency of the excavation or of the compaction.

It is clear that it is also possible to modify the geometry of the tool for obtaining a higher passage for the material which reflows during the excavation, reducing thus the one dedicated to the compaction. However, in this case the opening part has an angle higher than 180° and for obtaining a complete separation between the lower casting zone and the higher compaction one, it is necessary that rotating plate 14 is constituted by at least two pieces which in closed position are superposed the one on the other occupying an angle lower than 180° and once rotated, extend for an angular coverage higher than 180°, as they were telescopic. This technical solution is more complex than the preceding ones because it introduces seal and dragging issues among the parts wherein the rotating plate must be constituted.

In FIGS. 14-26 it is shown a third alternative form where the screw spirals are four and all of them are opposed. For making the system of thrusts on the soil and on the structures functioning with efficacy and completely balanced, both during the excavation and during the compaction, it is advantageous to keep opposed the ascent volumes, such as the ones of compaction. It is clear that the axial development of the tool can be chosen according to the soil, in order to have a sufficient volume dedicated to the passage of the material, which in this case is subdivided into four steps and not anymore two as the previously described forms.

Therefore, it is intuitive to think that it is possible to make tools with a plurality of screw spirals, for instance even three spirals, wherein two of them are dedicated to the passage of the material in compaction and one to the ascent of the material in drilling and vice versa.

In FIGS. 27-30 it is shown a system for locking the rotation for instance applied to the tool of the second embodiment but it can be applied also to the others without any distinction, constituted by a stop 30 which acts in contrast with elastic means 31 which keep it protruding with respect to the spiral upon which they are fixed, which is integral with the rotating part.

Figure 27:
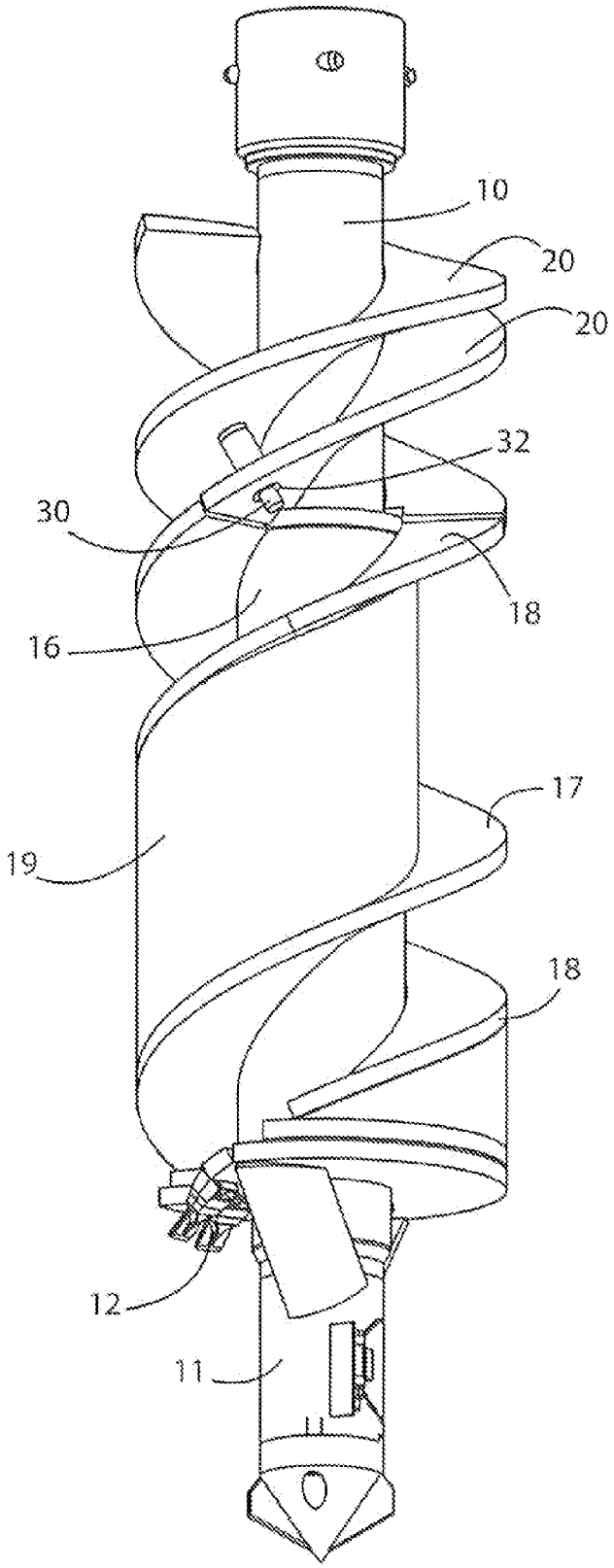
FIGS. 27-30 are perspective views of a tool with two-principle screws of the type shown in FIGS. 5-14, wherein there is a device for locking the rotation, in different operating steps.
Figure 28:
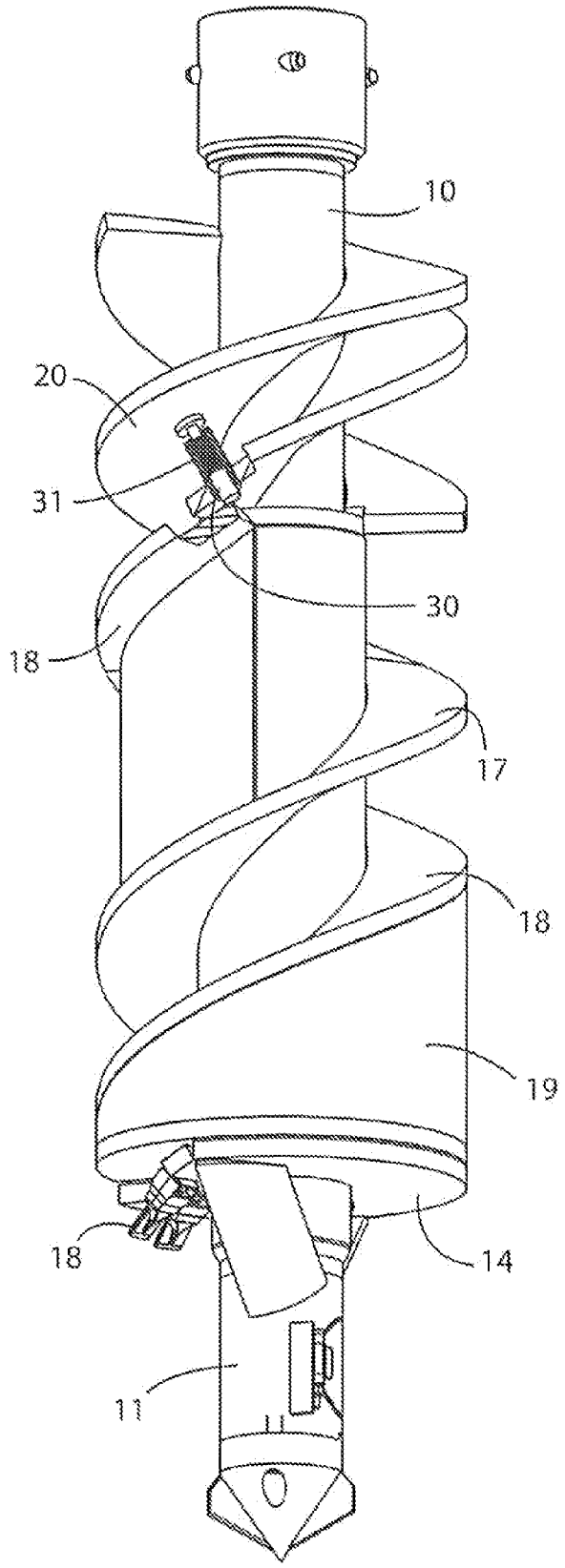
Figure 29:
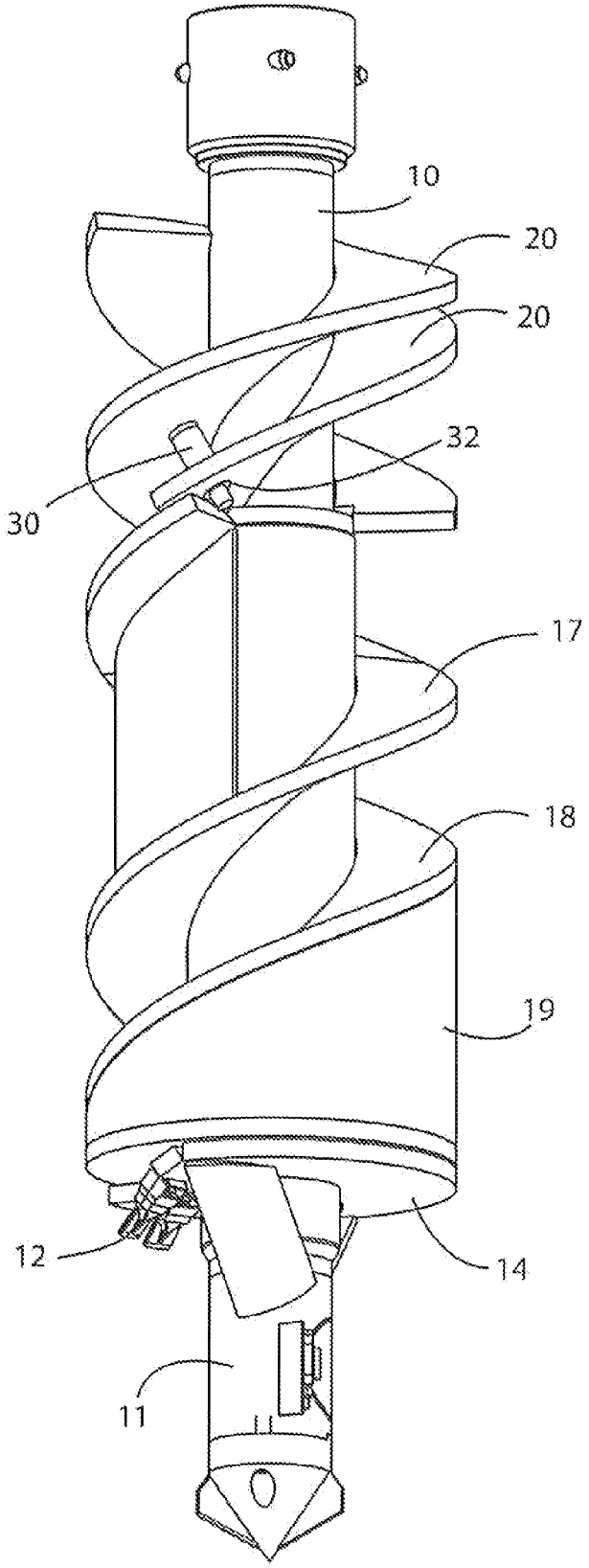
Figure 30:
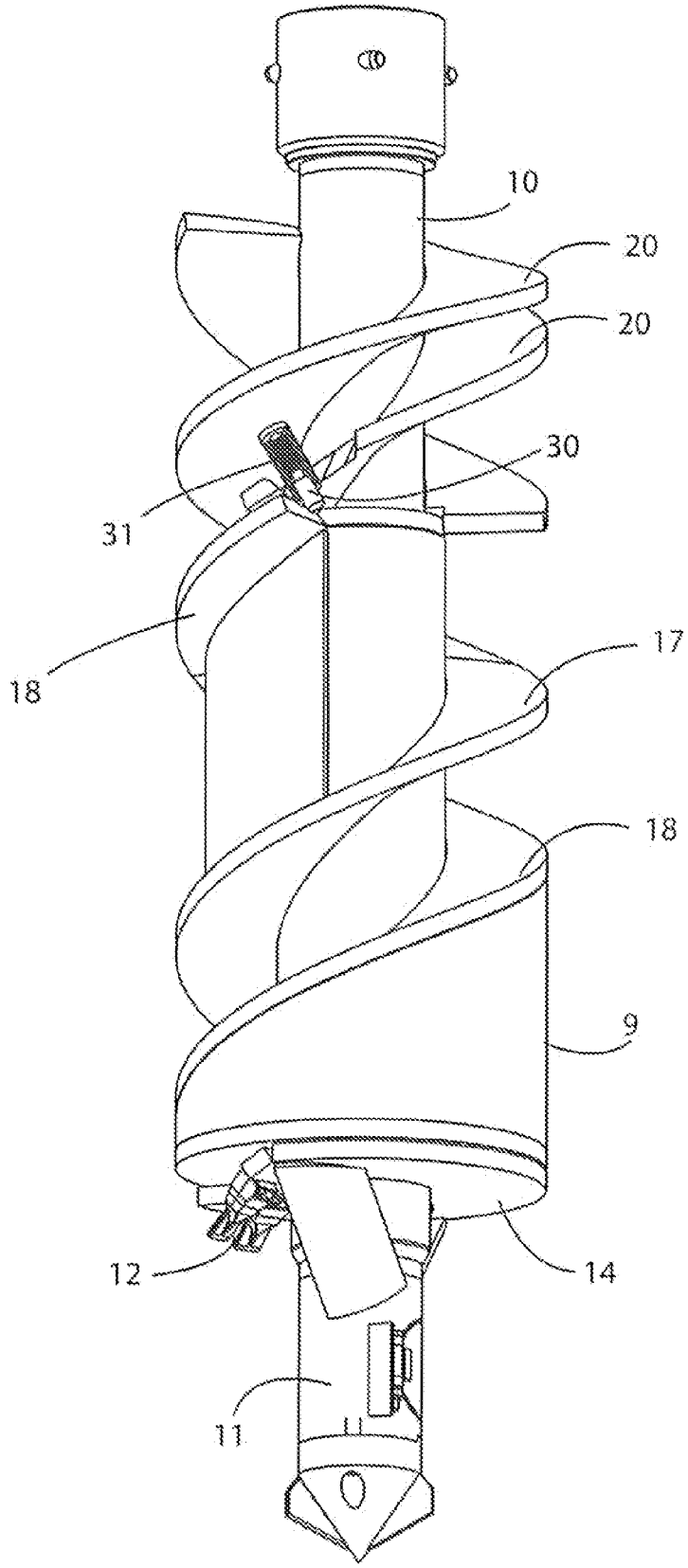

Starting from the condition of FIG. 27 wherein stop 30 is not pressed and freely protrudes through a hole 32 of screw 20, the relative rotation between the fixed and the rotating part, brings to the progressive contact between screw 18 and stop 30 (FIG. 28), which once pressed and let the screw through, goes back down pushed by spring 31 and locks the possible angular movements between the parts (FIGS. 29 and 30).

The system can be manually rearmed once the tool has finished the work and ends outside of the excavation. It is evident that analogous systems which similarly lock the two parts, at least temporarily, for ensuring the closing of the plate during the casting step, are all to be considered equivalent to the one described. Even the most complex systems which use the axial movements, or other devices or different sources of energy, which can make the stop unlocked from its locked position, are details which add nothing to what is described.

The system conceived has different advantages:

1) the ascent speed during the treatment is slowed and thus can be more easily coordinated to the filling with pumped concrete. This is due to the reduction of the screw pitch obtained with the two principles, of which one is not used in one of the working steps.

2) the quality of the pile is optimal because the long stabilization tract to the maximum diameter of compaction permits to re-pass many times the same soil portion, causing progressive compactions which make the walls of the hole more stable.

3) the closing of the rotating plate is safer thanks to the increasing of the contact surfaces of the soil of the parts integral with the plate itself (here are included the upper parts with the screw spirals). In the version with the locking element between the parts in relative rotation is also averted the possible reopening of the plate, once it has been brought in closing condition, ready for the casting and compaction step.

The invention claimed is:

1. Excavation equipment for the construction of compaction piles comprising a tool mounted at the end of a drilling rod; the tool comprising:

a shaft provided on an end with digging teeth and with at least a plate for collecting debris;

a screw extending around the shaft; and an inward radially extending compactor for compacting ground dislocated along said screw;

wherein the screw comprises at least two screw elements, in an upper part fixed directly on the shaft and in a lower part fixed on a cylindrical element inserted on the shaft; the compacting compactor being positioned on the screw of the cylindrical element; the shaft and the plate rotating between a first position corresponding to excavation and a second position corresponding to ascent; wherein the first position of the plate is an open position and the second position of the plate is a closed position; each of the at least two screw elements of the shaft comprising a continuation of a corresponding screw of the cylindrical body depending on the angular position of the shaft.

2. Excavation equipment according to claim 1 wherein the first position of the shaft and the second position of the shaft are displaced at an angle equivalent to 180°.

3. Excavation equipment according to claim 1 wherein the first position of the shaft and the second position of the shaft are displaced between at an angle lower than 180°.

4. Excavation equipment according to claim 1 wherein the first position of the shaft and the second position of the shaft are displaced at an angle greater than 180°.

5. Equipment according to claim 1 wherein the compactor has a maximum diameter that has an axial extension greater than half of the value of a compaction diameter.

6. Equipment according to claim 1 wherein the compactor has a maximum diameter that has an axial extension between one and two times a maximum compaction diameter.

7. Equipment according to claim 1 wherein the plate can be removed with respect to the shaft.

8. Equipment according to claim 1 wherein the screws screw comprises three screw elements.

9. Equipment according to claim 1 wherein the screw comprises four screw elements.

10. Equipment according to claim 1 further comprising a mechanical stop that works in contrast with elastic means to block the angular position between the parts in relative rotation, once the closing rotation has been completed and the plate, being in closed position, completely divides a casting area from a compaction area.

* * * * *